US011994334B2

(12) United States Patent
Kim et al.

(10) Patent No.: US 11,994,334 B2
(45) Date of Patent: May 28, 2024

(54) SUPERCOOLING FREEZER BOX

(71) Applicant: Ji Yong Park, Seoul (KR)

(72) Inventors: Han Seok Kim, Gyeonggi-do (KR); Ji Yong Park, Seoul (KR)

(73) Assignee: Ji Yong Park, Seoul (KR)

( * ) Notice: Subject to any disclaimer, the term of this patent is extended or adjusted under 35 U.S.C. 154(b) by 0 days.

(21) Appl. No.: 17/622,889

(22) PCT Filed: Jun. 25, 2019

(86) PCT No.: PCT/KR2019/007655
§ 371 (c)(1),
(2) Date: Dec. 27, 2021

(87) PCT Pub. No.: WO2020/262724
PCT Pub. Date: Dec. 30, 2020

(65) Prior Publication Data

US 2022/0235994 A1 Jul. 28, 2022

(30) Foreign Application Priority Data

Jun. 24, 2019 (KR) ..... 20190075047

(51) Int. Cl.
*F25D 17/08* (2006.01)
*F25D 11/00* (2006.01)
(Continued)

(52) U.S. Cl.
CPC ..... *F25D 17/08* (2013.01); *F25D 11/006* (2013.01); *F25D 17/045* (2013.01);
(Continued)

(58) Field of Classification Search
CPC ..... F25D 21/14; F25D 21/06; F25D 11/006; F25D 25/028; F25D 2325/023;
(Continued)

(56) References Cited

U.S. PATENT DOCUMENTS 6,094,931 A 8/2000 Jeong
7,987,684 B2 8/2011 Jeong et al.
(Continued)

FOREIGN PATENT DOCUMENTS

CN 107990617 * 5/2018 ..... F25D 17/062
EP 1137901 B1 5/2005
(Continued)

OTHER PUBLICATIONS

English language translation of WO201212327. Translated May 2023. (Year: 2012).*
(Continued)

*Primary Examiner* — Cassey D Bauer
(74) *Attorney, Agent, or Firm* — STIP Law Group, LLC

(57) ABSTRACT

A supercooling refrigerator (1000) including: a refrigerator body (100); a door (200) for opening and closing one side of the refrigerator body (100); an accommodating portion (400) provided inside the refrigerator body (100) and seated with an object (M) to be stored; a cooling duct (600) including a fan for taking in air in the refrigerator body (100) and discharging the air, and an evaporator (630) for cooling the air discharged from the fan; and a cool air supply duct (700) formed with a cool air discharge port (710) through which the air cooled through the cooling duct (600) is discharged into the refrigerator body (100), the fan being a cross flow fan (620) including a plurality of discs (622), and a plurality of blades (623) disposed between the discs (622) along outer circumferential surfaces of the discs (622).

6 Claims, 10 Drawing Sheets

(51) Int. Cl.

| | |
|---|---|
| ***F25D 17/04*** | (2006.01) |
| ***F25D 17/06*** | (2006.01) |
| ***F25D 21/08*** | (2006.01) |
| ***F25D 25/02*** | (2006.01) |

(52) U.S. Cl.
CPC ..... *F25D 17/067* (2013.01); *F25D 21/08* (2013.01); *F25D 25/028* (2013.01); *F25D 2317/061* (2013.01); *F25D 2317/067* (2013.01); *F25D 2317/0681* (2013.01)

(58) Field of Classification Search
CPC ..... F25D 17/08; F25D 17/067; F25D 2317/0683; F25D 17/045; F25D 2317/061; F25D 2317/067; F25D 2317/0681; F28D 2020/0013; A47F 3/04–3/0434
See application file for complete search history.

(56) References Cited

U.S. PATENT DOCUMENTS

2008/0122324 A1* 5/2008 Bienick ..... F25D 23/02 49/501
2009/0064707 A1* 3/2009 Smith ..... F25D 25/028 62/465
2009/0173093 A1 7/2009 Sueda et al.
2015/0342371 A1* 12/2015 Leong ..... F25D 21/14 62/247
2018/0087823 A1 3/2018 Han et al.
2018/0112906 A1 4/2018 Yi et al.

FOREIGN PATENT DOCUMENTS

| | | | | |
|---|---|---|---|---|
| JP | 09-280714 | A | 10/1997 | |
| JP | H09280714 | A | 10/1997 | |
| JP | H10206005 | A | 8/1998 | |
| KR | 20000009207 | A | 2/2000 | |
| KR | 20000008994 | U | 5/2000 | |
| KR | 200355272 | Y1 | 7/2004 | |
| KR | 200431862 | Y1 | 11/2006 | |
| KR | 20080009216 | A | 1/2008 | |
| KR | 20170008458 | A | 1/2017 | |
| WO | WO2012123271 | * | 9/2012 | ..... F25D 11/006 |
| WO | WO2015064930 | A1 | 5/2015 | |

OTHER PUBLICATIONS

English language translation of CN 107990617. Translated May 2023 (Year: 2018).*
International Search Report, dated Mar. 23, 2020, corresponding to PCT/KR2019/007655.

* cited by examiner (a)

(b)

(a)

(b)

SUPERCOOLING FREEZER BOX

TECHNICAL FIELD

The present invention relates to a supercooling refrigerator, and more particularly, to a supercooling refrigerator capable of reducing the frequency of operation of a compressor, reducing an amount of cool air escaping during door opening, and uniformly supplying a low-speed cool air to the interior of the refrigerator.

BACKGROUND ART

Supercooling refers to a phenomenon in the process of cooling a matter, in which the matter is cooled below a phase change temperature without it undergoing the phase change. Matter has a stable state according to each temperature and when the temperature is gradually changed, the matter follows the change in temperature with the constituent atoms of the matter maintaining the stable state at each temperature. Meanwhile, if there are insufficient nuclei for forming crystals in the matter, the phase change does not occur even when the temperature of the matter is dropped to the phase change temperature or lower. Additionally, when the temperature of the matter changes rapidly, there also occurs a phenomenon in which the constituent atoms maintain the same stable state as they are at the starting point temperature, or some are changed to a state at the end point temperature but then stopped, because the constituent atoms do not have enough time to change to a stable state according to each temperature.

That is, when a certain matter in solid state undergoes a change with reference to a certain temperature T as a boundary, that is, when this solid matter is changed to another crystal form of solid or melt to liquid at temperature $T_1$ ($T_1 \geq T$), if the matter is rapidly cooled down to a certain temperature below temperature $T_1$, the change does not occur, and the matter remains liquid even at the temperature below a freezing point, or the matter maintains the stable crystalline state that it had at the temperature $T_1$ even though the temperature is lower than the temperature T. This is called supercooling, meaning cooling that occurs extremely quickly.

Meanwhile, since an object in the supercooled state is in a so-called metastable state, this object is apt to change from the unstable equilibrium state toward a more stable state even with a slight stimulus. That is, when supercooled liquid is added with a small piece made up of the same components as the liquid or when the liquid is subjected to a slight impact such as sudden shaking, the supercooled liquid starts to solidify immediately, so that the temperature of the liquid is raised to the freezing point and a stable equilibrium state is maintained at that temperature.

In recent years, techniques for storing fish, meat, fruits, vegetables and other processed foods using such supercooling phenomenon have been developed. Particularly, technique is receiving increasing attention, which stores beverage such as water or liquor in a supercooled state and then provides the beverage in a slush form to a consumer by pouring the beverage to a cup or applying an impact to the beverage. However, as can be seen from the cooling curve shown in FIG. 10, since the matter generally maintains the supercooled state for only a short time, a separate operation is required to keep the food or beverage in a supercooled state for a prolonged time.

As an example of a refrigerator using the supercooling phenomenon, a refrigerator is disclosed in Korean Patent Registration Publication No. 10-1205822.

As shown in FIG. 11, the refrigerator disclosed in Publication described above includes a cooling chamber 2 for accommodating a container P of liquid beverage, a heat exchanger 9 for cooling the air in the cooling chamber 2, a cooling duct 5 incorporating the heat exchanger 9 therein, an intake port 10 provided in a portion of the cooling duct 5, a cool air discharge port 12 provided at a position different from the intake port 10 of the cooling duct 5, a cool air supply duct 6 for circulating air in the cooling chamber 2, an introducing port 15 provided at one end of the cool air supply duct 6, a vent hole 20 for blowing air in the cool air supply duct 6 into the cooling chamber 2, and a fan 16 mounted so as to face the introducing port 15 of the cool air supply duct 6. In such a refrigerator, the cooling duct 5 is configured to take in the air in the cooling chamber 2 from the intake port 10, and cool the air at the heat exchanger 9 and then blow out the air through the cool air discharge port 12, the cool air supply duct 6 is provided in up and down direction of the cooling chamber 2 on a side surface of the cooling chamber 2, the introducing port 15 faces the cool air discharge port 12 of the cooling duct 5 and also faces the inside the cooling chamber 2, and the air is taken into the cool air supply duct 6 from the introducing port 15 by the fan 16.

However, above-described the conventional refrigerator is provided with the rotary type fans such as fan blades, which include an intake fan 11 for supplying the air in the cooling chamber 2 to the cooling duct 5, and the fan 16 for supplying a cool air cooled along the heat exchanger 9 to the cool air supply duct 6. In the case of such a rotary fan, since the fan is rotated in a specific direction (clockwise or counterclockwise), the direction of the air is biased to one side, which causes uneven distribution of temperature of the cool air according to the positions in the refrigerator. Further, in order to reduce the uneven distribution of the cool air temperature in the refrigerator, the number and arrangement of the vent holes 20 to discharge the cool air into the cooling chamber 2 are adjusted, but with this configuration alone, reduction of the uneven distribution of temperature of the cool air is limited.

Further, in the above-described conventional refrigerator, the container P is seated on a flat plate-like shelf plate 3, but this causes the cool air discharged from the vent holes 20 to be obstructed by the upper and lower surfaces of the shelf plate 3, resulting in inefficient circulation of cool air in the refrigerator. As a result, uneven distribution of temperature of the cool air occurs according to the positions in the refrigerator.

Further, in the above-described conventional refrigerator, the air in the refrigerator is supplied to the cooling duct 5 through the intake fan 11, and cooled by heat exchange with the heat exchanger 9, and then passed through cool air supply duct 6 to be directly discharged into the refrigerator through the cool air discharge port 12. As a result, the cool air, which is dropped in temperature as it is passed through the heat exchanger 9, has a rising temperature as it is passed through the relatively long cool air supply duct 6, and this causes an increased temperature difference between the upper and lower parts even inside the refrigerator (for example, when the temperature inside the refrigerator is set to −6° C., the actual temperature of the heat exchanger can be dropped to below −20° C.). As a result, the temperature of the container P is varied depending on the positions in the refrigerator, and the probability of freezing of the container P is increased. Further, since the cool air is directly discharged into the refrigerator through the cool air discharge port 12, the discharge rate is relatively fast such that an increased amount of cool air escapes to the outside when the user opens the door 7.

As described above, in the supercooling refrigerator, it is important to maintain the temperature inside the refrigerator within an appropriate range so as to keep the stored object in the supercooled state. Therefore, in order to prevent the temperature inside the cooling chamber from rising due to the heat transfer with the outside air or the outflow of cool air during opening and closing of the door, and also to reduce the temperature changes inside the refrigerator, not only a heater, but also a 1 HP or ½ HP over-spec, high capacity compressor is used. Further, the compressor is subjected to frequent ON/OFF. As a result, the conventional supercooling refrigerator makes a considerable noise of 60 db or greater, needs improvement in energy efficiency, and has a short life of the compressor.

SUMMARY OF INVENTION

Technical Problem

The present invention has been made to solve the problems of the related art described above, and it is an object of the present invention to provide a supercooling refrigerator capable of reducing the frequency of operation of the compressor, reducing the amount of cool air escaping when the door is opened, and uniformly supplying low-speed cool air to the interior of the refrigerator.

Solution to Problem

The supercooling refrigerator 1000 according to an embodiment of the present invention, includes a refrigerator body 100; a door 200 for opening and closing one side of the refrigerator body 100; an accommodating portion 400 provided inside the refrigerator body 100 and seated with an object M to be stored; a cooling duct 600 including a fan for taking in air in the refrigerator body 100 and discharging the air, and an evaporator 630 for cooling the air discharged from the fan, and a cool air supply duct 700 formed with a cool air discharge port 710 through which the air cooled through the cooling duct 600 is discharged into the refrigerator body 100, in which the fan is a cross flow fan 620 including a plurality of discs 622, and a plurality of blades 623 disposed between the discs 622 along outer circumferential surfaces of the discs 622.

In the supercooling refrigerator according to an embodiment of the present invention, a cool air flow rate adjusting unit 730 may be formed on an upstream side of the cool air supply duct 700 through which the cooled air flows, such that a cross sectional area of a flow of the cooled air is narrowed.

In the supercooling refrigerator according to the embodiment of the present invention, the accommodating portion 400 may include a plurality of shelves 410 formed by wires crossed with each other, and shelf supports 420 for supporting the shelves 410, and a cold insulator 430 is inserted into the wires.

In the supercooling refrigerator according to the embodiment of the present invention, the evaporator 630 may include a refrigerant flow pipe 631 through which a refrigerant is moved, and a cold insulation member 632 fitted onto the refrigerant flow pipe 631 and supported thereon.

In the supercooling refrigerator according to the embodiment of the present invention, the cool air supply duct 700 may include a cool air discharge mesh 720 attached to the cool air discharge port 710 in a direction of the door 200.

In the supercooling refrigerator according to the embodiment of the present invention, the door 200 may include a plurality of glasses 210 stacked on each other with a spacer 220 interposed therebetween, and a heat insulating gas may be sealed in the spacer 220.

In addition, the supercooling refrigerator according to the embodiment of the present invention may additionally include a machine chamber 300 installed in a side of the refrigerator body 100 to drive a cooling cycle of the supercooling refrigerator 1000, in which, during defrosting, the machine chamber 300 may defrost the evaporator 630 using a hot gas defrosting method, and defrosted water may be collected into a water collector 310 provided in the machine chamber 300 and evaporated.

Advantageous Effects of Invention

According to the present invention, it is possible to provide a supercooling refrigerator capable of reducing the frequency of operation of a compressor, reducing an amount of cool air escaping during door opening, and uniformly supplying low-speed cool air into the interior of the refrigerator.

BEST MODE FOR CARRYING OUT THE INVENTION

Hereinafter, a supercooling refrigerator 1000 according to an embodiment of the present invention will be described in detail with reference to the accompanying drawings.

Figure 1:
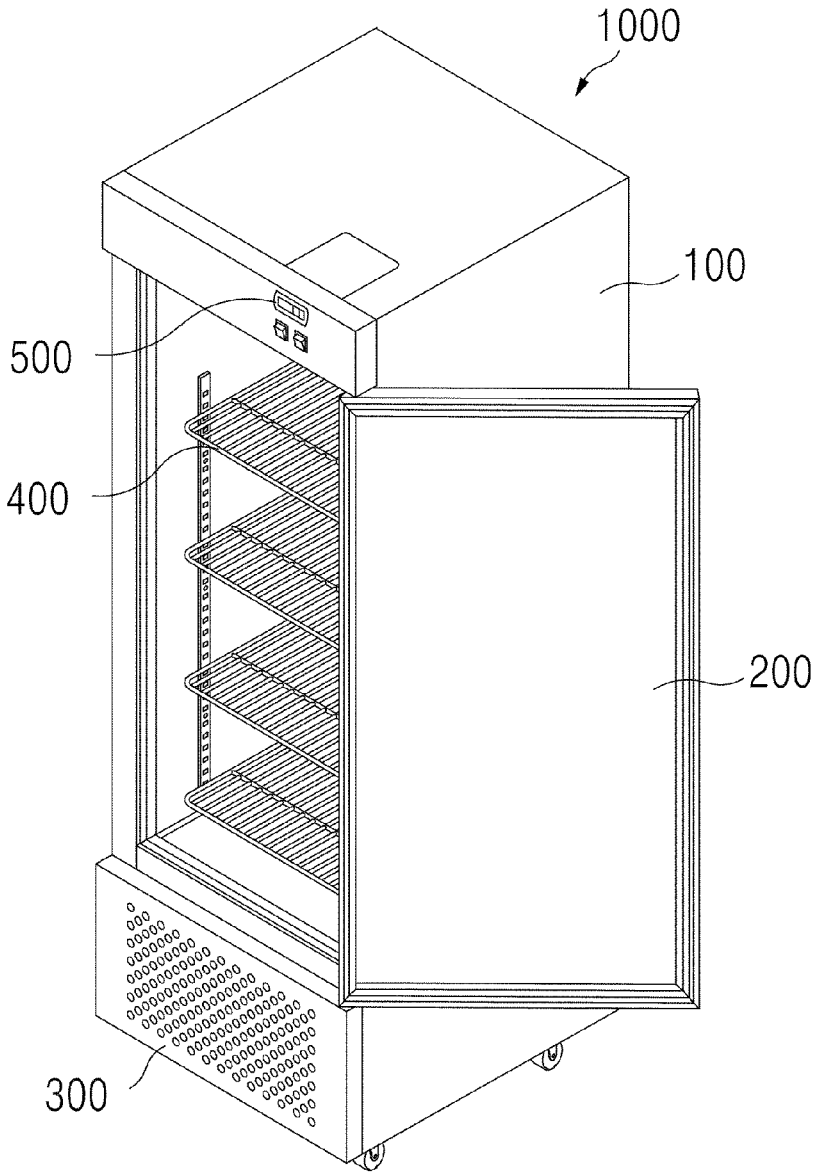
FIG. 1 is a perspective view showing a supercooling refrigerator according to an embodiment of the present invention.
Figure 2:
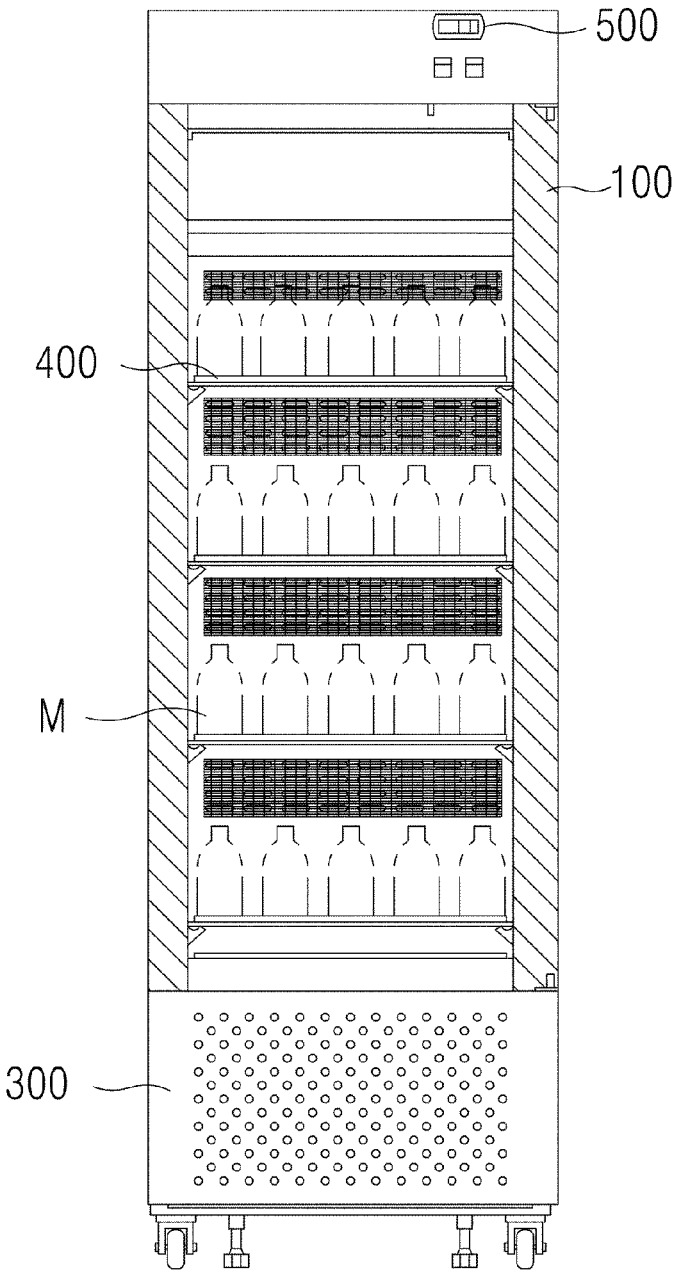
FIG. 2 is a front view showing a supercooling refrigerator according to an embodiment of the present invention.

FIG. 1 is a perspective view showing a supercooling refrigerator according to an embodiment of the present invention, and FIG. 2 is a front view showing a supercooling refrigerator according to an embodiment of the present invention. For reference, in FIG. 1, a side where a door 200 is installed is defined as a front, and with reference to this, a front and back direction, an up and down direction, and a left and right direction are defined. The front and back direction corresponds to a longitudinal direction of the supercooling refrigerator 1000, and the up and down direction corresponds to a height direction of the supercooling refrigerator 1000, and the left and right direction corresponds to a width direction of the supercooling refrigerator 1000, respectively.

As shown in FIGS. 1 and 2, the supercooling refrigerator 1000 according to an embodiment of the present invention includes a refrigerator body 100, a door 200, a machine chamber 300, an accommodating portion 400, and a controller 500. The refrigerator body 100 may have various shapes, and in one embodiment of the present invention, the refrigerator body 100 has a rectangular parallelepiped shape. An object M is accommodated inside the refrigerator body 100. The object M includes meat, fish, vegetables, fruits, beverages, liquors and other processed foods.

The supercooling refrigerator 1000 according to an embodiment of the present invention may be set so as to maintain the temperature in the refrigerator from −6° C. to −6.5° C. with a deviation of about +3° C., and cause 80 to 120 bottles of carbonated drink or beer having a temperature of 20° C. or higher at room temperature to reach a supercooling state at the elapse of 6 hours after the start of cooling. In addition, the supercooling refrigerator 1000 may be set so as to keep the temperature in the refrigerator at −0.5° C. with a deviation of about +0.5° C., and store raw meat in a non-frozen state. However, the usage of the supercooling refrigerator 1000 is not limited to these applications only, and the various types of objects M described above may be kept in supercooled state, by appropriately varying the setting state of the supercooling refrigerator 1000 accordingly.

The door 200 is provided on one side of the refrigerator body 100. The door 200 is configured such that a user may open and close the door 200 while holding a handle (not shown) installed on one side of the door 200. The door 200 is formed of a plurality of layers of transparent glass so that the internal state of the supercooling refrigerator 1000 may be checked from the outside even when the door 200 is closed. Details of the door 200 will be described below.

The machine chamber 300 is formed in the lower portion of the refrigerator body 100. The machine chamber 300 includes members for operating the cooling cycle of the supercooling refrigerator 1000. Details of the machine chamber 300 will be described below.

The accommodating portion 400 for the object M to be seated thereon is installed in the interior of the refrigerator body 100. The accommodating portion 400 includes a plurality of shelves 410 and a plurality of shelf supports 420 supporting the shelves 410 (see FIG. 3). The plurality of shelves 410 are installed at intervals from each other in the height direction of the supercooling refrigerator 1000. The shelf 410 is configured such that the metal wires cross each other to form a framework of a rectangular parallelepiped shape, and the object M is inserted through an upper open side of the shelf 410. The plurality of shelf supports 420 are respectively provided on both side surfaces of the interior of the refrigerator body 100 to support both sides of the plurality of shelves 410. A height adjusting member is provided on the shelf support 420 so as to appropriately adjust a distance between the shelves 410 in consideration of the object M to be seated. Details of the shelf 410 will be described below.

As shown in FIG. 1, a controller 500 is formed on one side of an upper portion of the refrigerator body 100, and the controller 500 operates to control the current state of the supercooling refrigerator 1000 automatically or manually. Details of the controller 500 will be described below.

Figure 3:
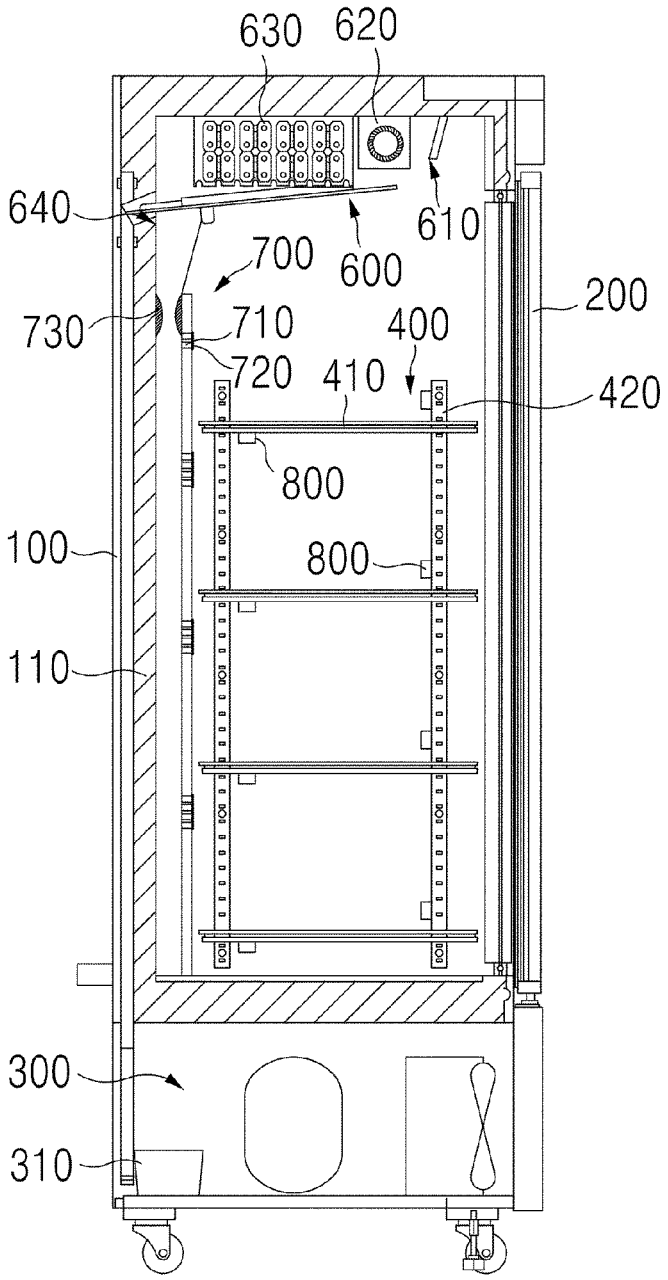
FIG. 3 is a side view showing a supercooling refrigerator according to an embodiment of the present invention.

FIG. 3 is a side view showing a supercooling refrigerator according to an embodiment of the present invention.

A heat insulator 110 is provided between outer and inner walls of the refrigerator body 100 to prevent heat transfer from occurring due to temperature difference between the interior and exterior of the supercooling refrigerator 1000. For the heat insulator, a cyclopentane foaming agent may be used, for example.

A cooling duct 600 is provided on an upper side of the interior of the refrigerator body 100 and an intake port 610 is formed on one side of the cooling duct 600 toward the direction of the door 200. A cross flow fan 620 and an evaporator 630 are installed inside the cooling duct 600, respectively. Further, an introducing port 640 is formed at one side of the cooling duct 600 opposite the door 200, and connected to a cool air supply duct 700 to be described below.

When the cross flow fan 620 is operated, the air inside the refrigerator body 100 is taken in through the intake port 610, and the intake air passes through the cross flow fan 620 and then through the evaporator 630. The air is deprived of heat by heat exchange with the evaporator 630 as passing through the evaporator 630 to be turned into a low temperature cool air, and the cool air is introduced into the cool air supply duct 700 through the introducing port 640. Details of the cross flow fan 620 and the evaporator 630 will be described below.

A cool air supply duct 700 is provided on a rear surface of the interior of the refrigerator body 100. One side of an upper portion of the cool air supply duct 700 is opened to be connected to the introducing port 640 of the cooling duct 600. A plurality of cool air discharge ports 710 are formed in the cool air supply duct 700 toward the direction of the door 200. In addition, a cool air discharge mesh 720 is attached to the cool air discharge port 710 toward the direction of the door 200, and the cool air that passed through the evaporator 630 is supplied to the interior of the refrigerator body 100 through the cool air discharge port 710 and the cool air discharge mesh 720. Details of the cool air discharge port 710 and the cool air discharge mesh 720 will be described below.

In addition, a cool air flow rate adjusting unit 730 is formed on one side of the upper portion of the cool air supply duct 700. The cool air flow rate adjusting unit 730 is a member such as a nozzle that increases the flow rate of the cool air by narrowing a cross-sectional area of a flow of the cool air passing through the cool air supply duct 700. In the present embodiment, protrusions are formed on an inner surface of the cool air supply duct 700 to narrow flow cross-sectional area of the flow of the cool air. Accordingly, the flow rate of cool air passing through the cool air flow rate adjusting unit 730 is increased, and the time for the cool air to reach the lowermost portion of the cool air supply duct 600 is shortened. Therefore, the temperature difference according to the height in the interior of the refrigerator body 100 may be reduced.

The machine chamber 300 is provided in a lower portion of the refrigerator body 100. A driving apparatus for driving the evaporator 630 is installed in the machine chamber 300.

Specifically, the driving apparatus includes an apparatus that forms a cooling cycle in cooperation with the evaporator 630, such as a compressor that compresses the high-temperature refrigerant that has passed through the evaporator 630, a condenser that takes heat from the refrigerant discharged from the compressor to convert the refrigerant into a liquid state, an expansion valve that converts the liquid refrigerant into a two-phase state, a cooling fan that cools down the condenser and the compressor, and the like. The position of the machine chamber 300 is not limited to the lower portion of the refrigerator body 100 and may be provided at an upper portion of the refrigerator body 100, in which case the distance to the evaporator 630 is shortened. The compressor, the condenser, the expansion valve, the cooling fan, and the like may be of any known configuration, and a detailed description thereof will be omitted.

In addition, a water collector 310 is installed in the machine chamber 300. The supercooling refrigerator 1000 according to the embodiment of the present invention does not include a separate defrost heater for defrosting the evaporator 630, unlike the conventional supercooling refrigerator. Instead, hot-gas defrosting method is employed, which reversely operates the cooling cycle to cause the refrigerant in a relatively high temperature state to flow to the evaporator 630 to remove the frost formed on the surface of the evaporator 630. In this process, the frost which is adhered onto the evaporator 630 is melted, generating water, and the generated water is collected in the water collector 310 of the machine chamber 300 through a drain plate installed at one side of the refrigerator body 100. The water collected in the water collector 310 evaporates due to the heat of the condenser installed inside the machine chamber 300, the wind from the cooling fan, and the like.

More specifically, when the fan installed in the condenser inside the machine chamber 300 is driven, outside air flows into the machine chamber 300 through a heat sink (see FIG. 1) attached to the outer wall of the machine chamber 300. The introduced outside air cools the condenser and the compressor in turn. The outside air whose temperature has risen due to the heat from the condenser and the compressor evaporates the defrost water of the water collector 310 and is then discharged to the outside through a rear surface of the machine chamber 300.

With the configuration described above, the supercooling refrigerator 1000 according to an embodiment of the present invention may reduce the electricity consumption by using the hot-gas defrosting method instead of employing a separate defrost heater to remove the frost of the evaporator 630. In addition, since the water collected in the water collector 310 is naturally evaporated in the machine chamber 300 without having to separately remove the water, the structure is simpler than the conventional supercooling refrigerator which required that a water collector be separately installed outside the refrigerator and should be periodically managed, while inconvenience in use is also reduced.

The sensor 800 may be installed in the supercooling refrigerator 1000 according to the present embodiment. The sensor 800 senses the internal temperature of the supercooling refrigerator 1000, a degree of occupancy by the object M, whether the door 200 is open or closed, a flow rate of the cool air, and the like. Specifically, the sensor 800 may be installed on a bottom surface of the shelf 410 to measure the degree of occupancy by the object M by measuring the weight of the object M, may be installed on one side of the shelf support 420 to measure temperature, may be installed on one side of the door 200 to detect whether the door 200 is open or closed, and may be installed on one side of the intake port 610 and the introducing port 640 of the cooling duct 600 or inside the cool air supply duct 700 to measure the flow rate of the cool air. The mounting position of the sensor 800 is not particularly limited, and may be any position as long as the current state of the supercooling refrigerator 1000 can be easily sensed. In addition, the sensor 800 is connected to the controller 500 described above. Accordingly, data on the current state of the supercooling refrigerator 1000 measured or sensed by the sensor 800 is transmitted to the controller 500.

Figure 4:
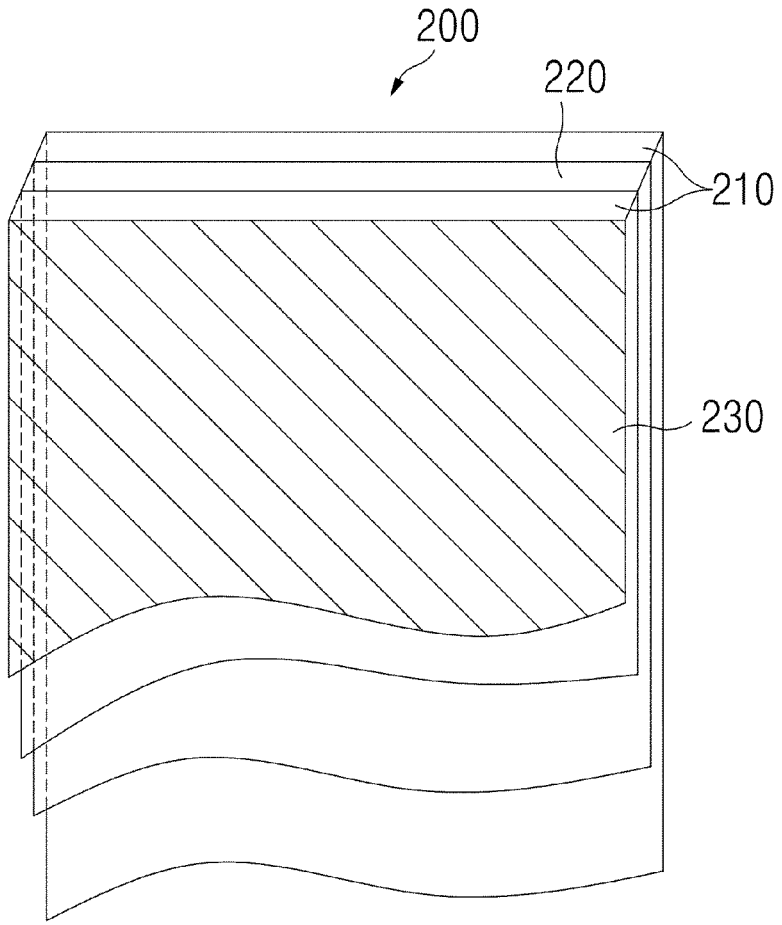
FIG. 4 is a detailed view showing a door according to an embodiment of the present invention.

FIG. 4 is a detailed view showing a door according to an embodiment of the present invention.

Referring to FIGS. 1 and 4, the door 200 has a plurality of glass 210 stacked in several layers in a longitudinal direction of the refrigerator body 100. In an embodiment of the present invention, two-fold or three-fold glasses 210 are stacked. For the glass 210, it is preferable to use tempered glass or safety glass having a higher strength than ordinary glass. The thickness of each glass 210 is not particularly limited, and in an embodiment of the present invention, the interval between respective glasses 210 is about 7 mm. A spacer 220 is formed between the respective glasses 210, and a heat insulator is inserted into the spacer 220 to minimize heat transfer that is caused by a temperature difference between the inside and outside of the supercooling refrigerator 1000. In one embodiment of the present invention, argon (Ar) gas, krypton (Kr) gas or nitrogen ($N_2$) gas serves as a heat insulator, and the argon gas, the krypton gas or the nitrogen gas is enclosed in the spacer 220. By enclosing the argon gas, the krypton gas or the nitrogen gas having a low thermal conductivity in the spacer 220, heat transfer inside and outside of the supercooling refrigerator 1000 may be suppressed to suppress the condensation phenomenon and the cold radiation phenomenon, and enhance the heat insulation performance. An anti-frost film 230 is attached to the inner glass 210 of the glasses 210. Further, a metal or a metal oxide may be thinly coated on one surface of the glasses 210 to further reduce the heat transfer.

Figure 5:
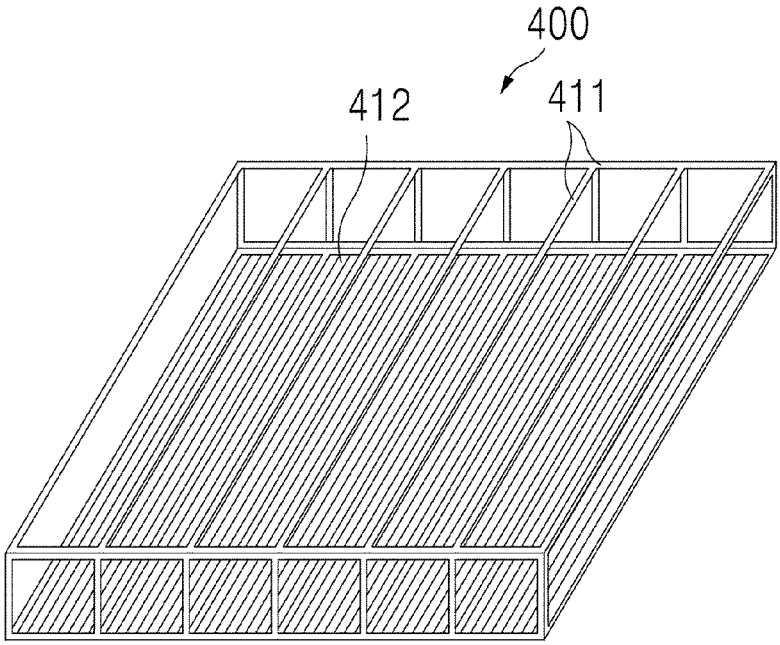
FIG. 5 is a detailed view showing a shelf according to an embodiment of the present invention, in which FIG. 5(*a*) is a perspective view showing a shelf and FIG. 5(*b*) is a cross-sectional view showing a first wire forming a shelf.
Figure 5:
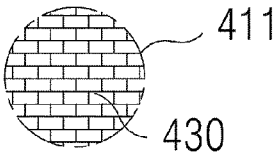

FIG. 5 is a detailed view showing a shelf according to an embodiment of the present invention.

The shelf 410 is configured with a plurality of metal wires crossing each other to form a framework of a rectangular parallelepiped shape. The metal wires forming the shelf 410 include a first wire 411, and a second wire 412 having a smaller diameter than the first wire 411. The first wire 411 includes a frame wire forming the framework of the rectangular parallelepiped shape of the shelf 410, and a guide wire compartmenting the shelf 410 in the width direction of the supercooling refrigerator 1000. The guide wire serves to compartment the shelf 410 into regions for the object M to be seated and also to prevent the object M from collapsing or freezing due to external impact or internal vibration. The number of the guide wires is not particularly limited, and in this embodiment, the guide wires are configured such that the objects M may be arranged in six rows when viewed from the front. A plurality of second wires 412 are provided between the first wires 411 located on the bottom surface of the shelf 410 to forma bottom of the shelf 410. The object M is inserted through the upper side of the shelf 410 and is supported by the second wire 412.

That is, unlike the flat or box-shaped shelves employed in the conventional supercooling refrigerator, the shelf 410 according to the embodiment of the present invention is formed such that the metal wires cross each other, and thus all the sides where the object M and cool air are in contact with each other are open. Therefore, one of the problems of the conventional supercooling refrigerator, that is, the phenomenon in which the cool air is hit against the shelf and reduced in speed, that leads into accumulation of the cool air, is prevented, and the contact area between the object M and cool air may be widened. Particularly, since the bottom side of the shelf 410 is also formed of the second wires 412 rather than as a flat plate, the contact area between the bottom surface of the object M and the cool air may be maximized, thus resulting in further increased cooling efficiency.

In addition, the cold insulator 430 is inserted into the first wire 411. The cold insulator 430 is kept in a solid state in the operating temperature range of the supercooling refrigerator 1000, and when the user opens the door 200, allowing the outside air to flow into the interior of the supercooling refrigerator 1000, the cold insulator 430 inserted into the first wire 411 absorbs the heat of the outside air to minimize the temperature change inside the supercooling refrigerator 1000.

This temperature maintaining effect of the cold insulator 430 will be described in more detail as follows. For example, when the width of the shelf 410 is set to 520 mm, the length is set to 550 mm, and the height is set to 100 mm, and there are a total of four shelves 410 provided in the height direction of the supercooling refrigerator 1000, and the diameter of the first wire 411 is set to 10 mm, and the interior of the first wire 411 is filled with the cold insulator 430, the total volume of the cold insulator 430 inserted into the entire shelf 410 is calculated as follows.

Total volume of the cold insulator 430 inserted into the upper and lower sides of each shelf 410= $(7\times550+2\times520)\times\pi/4\times10^2\times2\approx768.12\ cm^3$ Total volume of the cold insulator 430 inserted into the front and rear sides of each shelf 410=$7\times100\times\pi/4\times10^2\times2\approx109.96\ cm^3$ Total volume of the cold insulator 430 inserted into the entire shelf 410≈$(768.12+109.96)\times4=3512.32\ cm^3$ Accordingly, when compared to an ice pack having a volume of 200 $cm^3$, the shelf 410 according to an embodiment of the present invention has a heat capacity corresponding to about 17.56 ice packs. Accordingly, even when the cooling cycle of the supercooling refrigerator 1000 does not operate, the low temperature state may be maintained for a long time, and the operating frequency of the cooling cycle, that is, the frequency of operating the compressor may be reduced, thereby increasing the service life of the compressor. In the embodiment of the present invention, the cold insulator 430 is inserted into the first wire 411, but is not limited thereto, and the cold insulator 430 may also be inserted into the second wire 412. Further, the dimensions of the shelf 410 may be appropriately changed in consideration of the purpose of use of the supercooling refrigerator 1000 and the like.

Figure 6:
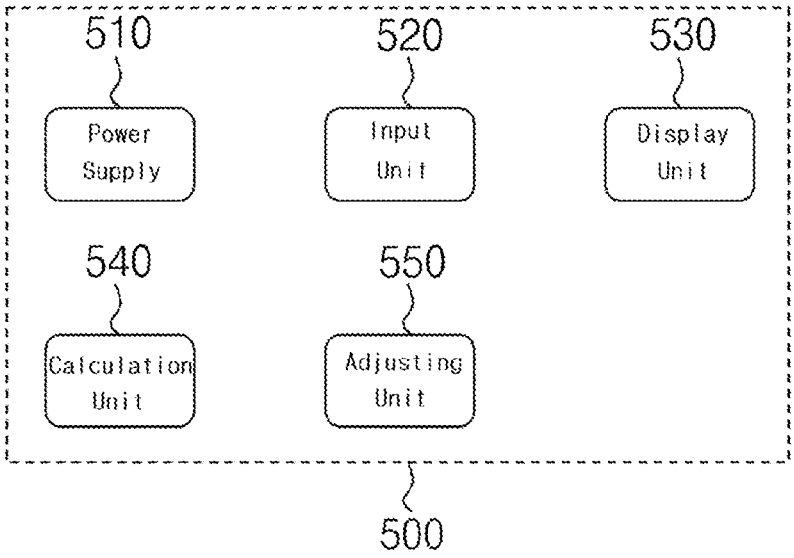
FIG. 6 is a block diagram showing a controller according to an embodiment of the present invention.

FIG. 6 is a block diagram showing a main configuration of a controller according to an embodiment of the present invention.

In the present embodiment, the controller 500 is attached to the upper portion of the refrigerator body 100, but is not limited thereto, and the controller 500 may be attached to a position that is easy for the user to operate or check. As described above, the controller 500 controls the current state of the supercooling refrigerator 1000 and is connected to the sensor 800. The controller 500 includes a power supply 510 capable of turning on and off the power of the supercooling refrigerator 1000, an input unit 520 that receives, from the sensor 800, data on the current state of the supercooling refrigerator 1000 (internal temperature, weight of the object M being accommodated, whether the door 200 is open or closed, flow rate of cool air, and the like), a display unit 530 indicating the current state of the supercooling refrigerator 1000, a calculation unit 540 that determines whether it is necessary to change the internal state of the supercooling refrigerator 1000 based on the received data, and an adjusting unit 550 that adjusts the internal temperature, the flow rate of cool air, and the like of the supercooling refrigerator 1000. In addition, the user may manually adjust the internal state of the supercooling refrigerator 1000 by inputting a desired temperature range or the like using an input panel (not shown) of the controller 500.

Figure 7:
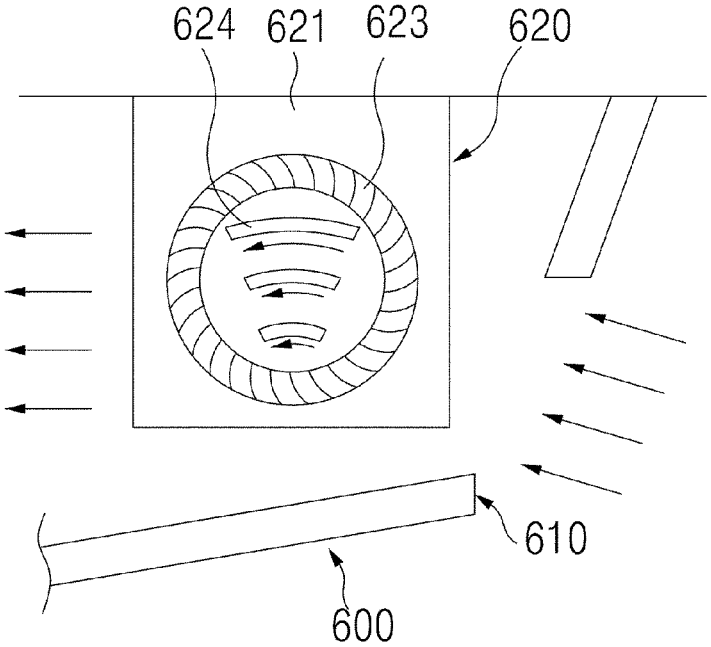
FIG. 7 is a detailed view showing a cross flow fan according to an embodiment of the present invention, in which FIG. 7(*a*) is a side view showing a cross flow fan, and FIG. 7(*b*) is a front view showing a cross flow fan.
Figure 7:
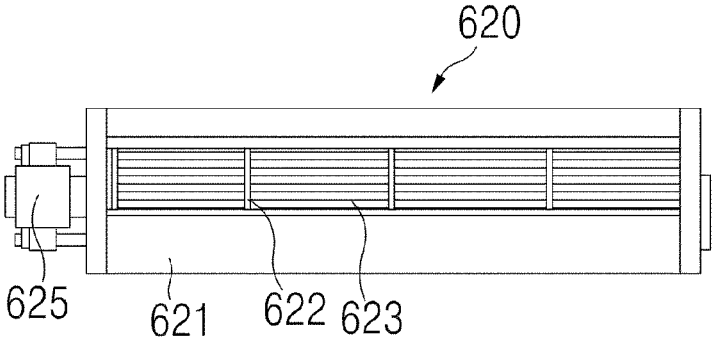

FIG. 7 is a detailed view showing a cross flow fan according to an embodiment of the present invention.

Referring to FIGS. 3 and 7, the cross flow fan 620 is installed inside the cooling duct 600 to take in air from the intake port 610 of the cooling duct 600 to generate a flow. The cross flow fan 620 includes a housing 621, discs 622, blades 623, a guide plate 624, and a fan motor 625.

The housing 621 is supported on both inner sides of the refrigerator body 100 and serves to accommodate and support the other members forming the cross flow fan 620. The disc 622 is a disc-shaped member, and a plurality of discs 622 are provided inside the housing 621 at predetermined intervals. A plurality of blades 623 serving as blowing blades of the cross flow fan 620 are provided between the respective discs 622. Each of the blades 623 is installed in a ring shape at predetermined intervals along a circumferential direction of the disc 622. A plurality of guide plates 624 are provided on the inner side of the blades 623, and form a flow path so that the intake air from one side of the cross flow fan 620 is discharged to the other side. The guide plates 624 are spaced apart from each other by a predetermined distance, and are bent to allow air to smoothly flow. The guide plate 624 is fixed to the housing 621 by a support member (not shown) and is not rotated by the operation of a fan motor 625 to be described below. The disc 622, the blade 623, and the guide plate 624 form one unit, and a plurality of units are coupled to each other in an axial direction. The fan motor 625 is coupled to one end of the cross flow fan 620 to drive the cross flow fan 620. The discs 622 and the blades 623 are axially rotated while being supported by the housing 621 in accordance with the operation of the fan motor 625.

As described above, the supercooling refrigerator 1000 according to the embodiment of the present invention employs the cross flow fan 620, unlike the conventional supercooling refrigerator using the rotary fan such as the fan blades. As a result, the air that has passed through the cross flow fan 620 is uniformly supplied to the evaporator 630 without being biased to one side and likewise, the cool air having passed through the evaporator 630 may pass through the cool air supply duct 700 to be uniformly discharged through the cool air discharge port 710.

Figure 8:
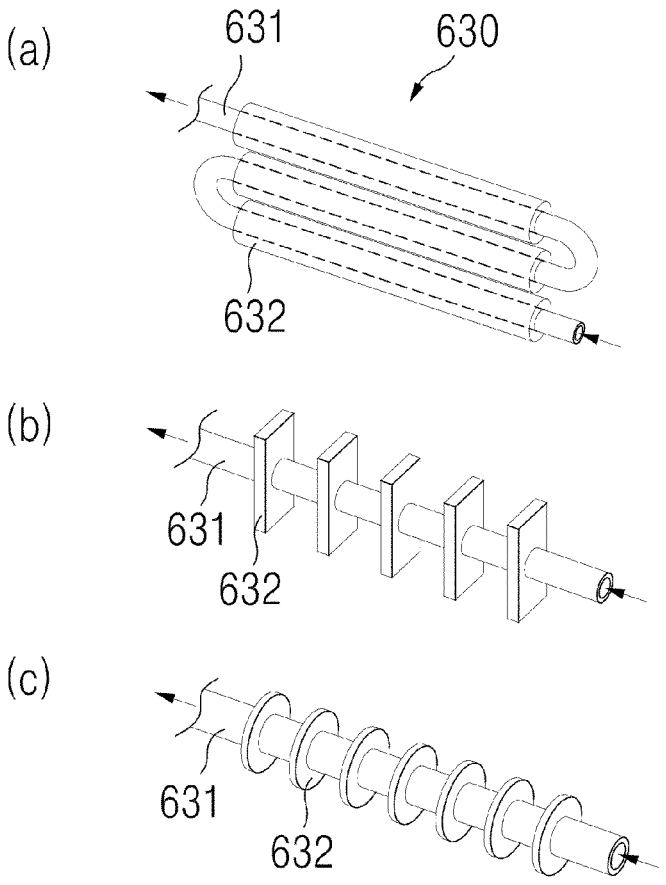
FIG. 8 is a detailed view showing an evaporator according to an embodiment of the present invention, in which FIG. 8(*a*) shows an evaporator in which a cylindrical cold insulation member is fitted, FIG. 8(*b*) shows an evaporator in which a cold insulation member of a rectangular parallelepiped shape is fitted, and FIG. 8(*c*) shows an evaporator in which a ring-shaped cold insulation member is fitted.

FIG. 8 is a detailed view showing an evaporator according to an embodiment of the present invention.

The evaporator 630 according to one embodiment of the present invention includes a refrigerant flow pipe 631 through which a refrigerant moves, and a cold insulation member 632 fitted onto the refrigerant flow pipe 631 and supported thereon.

The cold insulator inserted into the cold insulation member 632 is maintained in solid state during operation of the supercooling refrigerator 1000 of the present invention. As shown in FIGS. 8(*a*) to 8(*c*), the shape of the cold insulation member 632 may be a hollow cylindrical shape that covers the refrigerant flow pipe 631 in the axial direction or may be a block or a ring shape that is fitted onto the refrigerant flow pipe 631 and supported thereon. The shape and the number of the cold insulation member 632 are not particularly limited and may be appropriately employed in consideration of the shape of the evaporator 630 or the operating environment of the supercooling refrigerator 1000.

With this configuration, in the supercooling refrigerator 1000 according to an embodiment of the present invention, during operation of the cooling cycle, the cold insulation member 632 is maintained in a low temperature state through heat exchange with the evaporator 630, and when the cooling cycle is stopped, the cold insulation member 632 emits cool air to suppress the temperature rise in the supercooling refrigerator 1000. Thus, the frequency of operation of the cooling cycle, that is, the frequency of operation of the compressor may be reduced, thereby extending the service life of the compressor.

Figure 9:
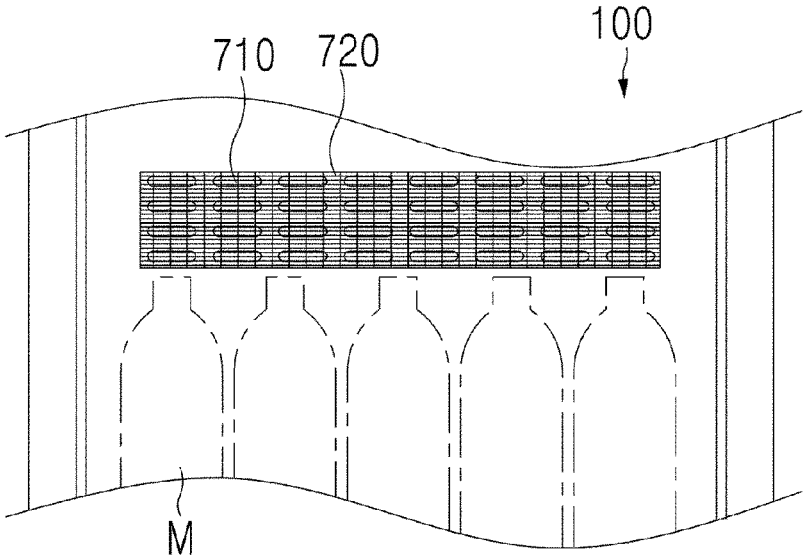
FIG. 9 is a detailed view showing a cool air discharge port and a cool air discharge mesh according to an embodiment of the present invention.
Figure 10:
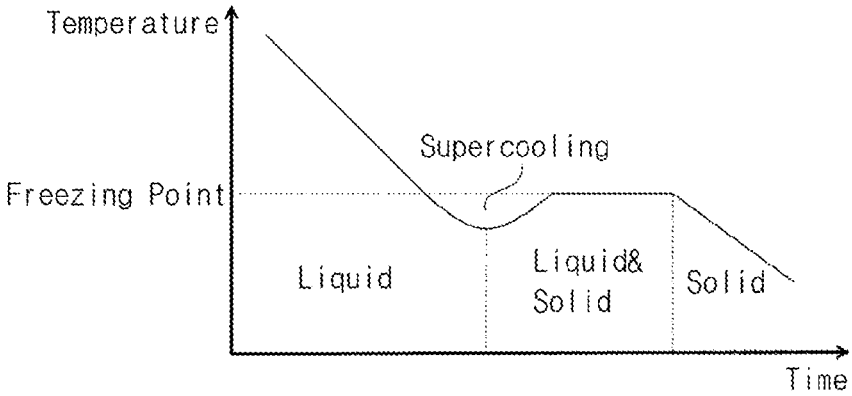
FIG. 10 is a view showing an ideal cooling curve.
Figure 11:
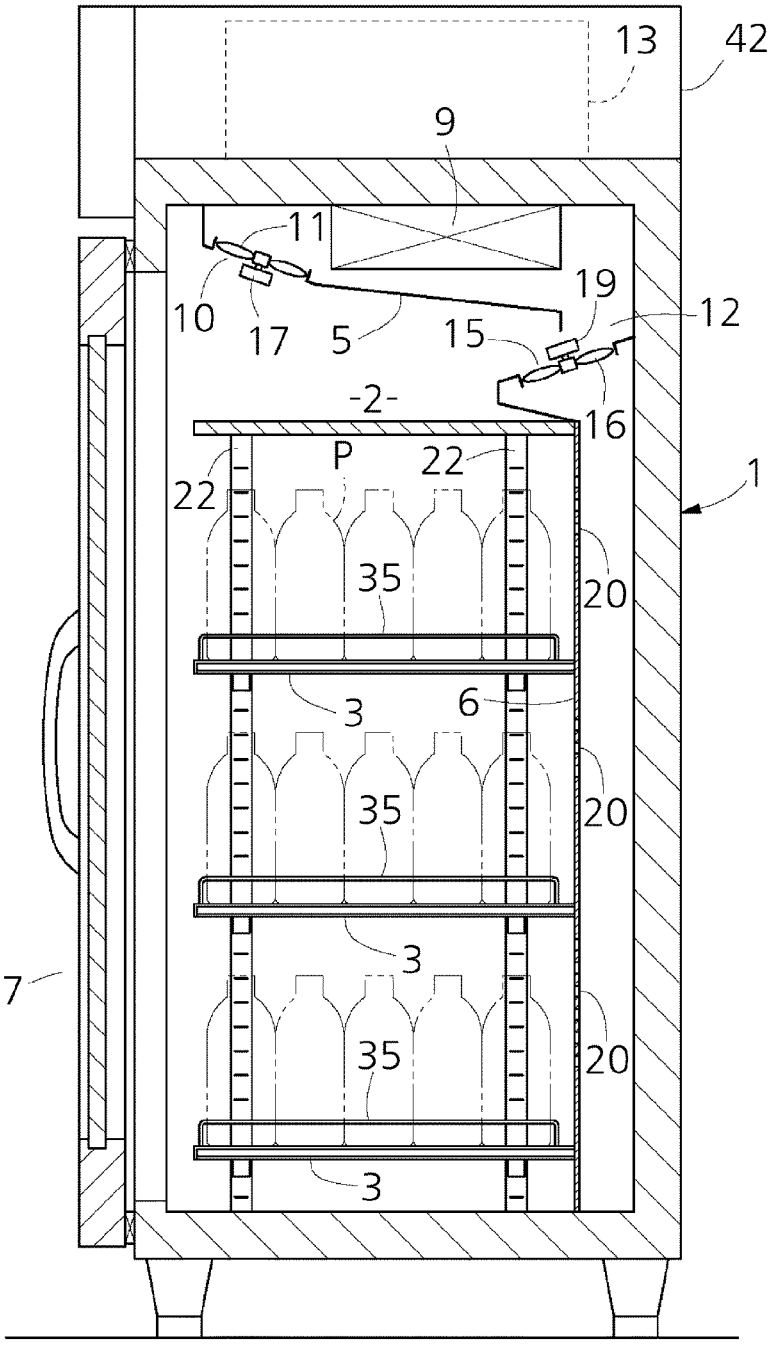
FIG. 11 is a view showing a conventional supercooling refrigerator.

FIG. 9 is a detailed view showing a cool air discharge port and a cool air discharge mesh according to an embodiment of the present invention.

Referring to FIGS. 3 and 9, a plurality of cool air discharge ports 710 are formed on one surface of the cool air supply duct 700 toward the direction of the door 200, and are distributed in vertical and horizontal directions. The cool air introduced into the cool air supply duct 700 through the cooling duct 600 is discharged to the interior of the refrigerator body 100 through the cool air discharge port 710.

Meanwhile, in the supercooling refrigerator 1000 according to the embodiment of the present invention, the cool air discharge mesh 720 is attached to the surface of the cool air supply duct 700 that is formed with the cool air discharge port 710. The cool air discharge mesh 720 is a fiber paper having a large number of fine holes formed therein, and may be formed of Korean paper, for example. As a result, the cool air cooled through the cooling duct 600 is discharged into the refrigerator body 100 through the cool air discharge port 710 and the cool air discharge mesh 720, instead of being directly discharged into the refrigerator body 100 through the cool air discharge port 710. Since a large number of fine holes are formed in the cool air discharge mesh 720, the cool air may be discharged uniformly and the discharging rate may be reduced as compared with the case where the cool air is directly discharged into the refrigerator body 100 through only the cool air discharge port 710. Therefore, the uneven distribution of the temperature inside the refrigerator body 100 may be reduced, and when the user opens the door 200, the amount of cool air escaping outside may be reduced.

Hereinafter, a method of operating the supercooling refrigerator 1000 according to an embodiment of the present invention will be described with reference to FIGS. 1 to 9.

First, the user places the object M in the accommodating portion 400 of the supercooling refrigerator 1000 and, using the controller 500, sets an appropriate temperature, wind intensity, and the like in accordance with the object M. Next, when the supercooling refrigerator 1000 is operated, the compressor, the condenser, the expansion valve, and the like of the machine chamber 300 are operated, and the evaporator 630 of the cooling duct 600 is also operated, and likewise, in response to the operation of the fan motor 625, the cross flow fan 620 is operated. When the cross flow fan 620 is operated, air in the refrigerator body 100 is taken into the cross flow fan 620 through the intake port 610 of the cooling duct 600 and then discharged to the evaporator 630. The cool air, which has been deprived of heat as passing through the evaporator 630 and is cooled to a low temperature, is moved to the cool air supply duct 700. In this process, since the cool air passing through the cross flow fan 620 is not biased to one side and is moved evenly, the uneven distribution of temperature in the interior of the refrigerator may be reduced as compared with the conventional supercooling refrigerator using the rotary fan.

As the cool air is passed through the cool air flow rate adjusting unit 730 formed at one side of the upper portion of the cool air supply duct 700, the flow rate is increased. With this configuration, the cool air may be rapidly moved to the lower portion of the cool air supply duct 700, so that the uneven distribution of temperature in the height direction inside the refrigerator may be further reduced as compared with the conventional supercooling refrigerator.

The cool air reaching the cool air supply duct 700 is discharged into the interior of the refrigerator body 100 through the cool air discharge port 710. In this process, due to the cool air discharge mesh 720 attached to one side of the cool air discharge port 710 toward the direction of the door 200, and a large number of fine holes formed in the cool air discharge mesh 720, the cool air may be uniformly discharged at a lower speed. With this configuration, the cool air may be discharged more uniformly, and particularly, the speed of the cool air may be effectively reduced as compared with the case where the cool air is discharged through only the cool air discharge port 710, so that the amount of cool air that escapes to the outside when the user opens the door 200 can be reduced.

That is, the cool air is supplied more quickly by using the cool air flow rate adjusting unit 730 of the cool air supply duct 700, so that the uneven distribution of temperature of the cool air according to the height is reduced, and the flow rate of the cool air thus accelerated is effectively reduced using the cool air discharge mesh 720 again. The cool air discharged through the cool air discharge mesh 720 uniformly spreads inside the refrigerator body 100 to efficiently cool the object M and to keep the object (M) in the supercooled state.

Further, since the shelf 410 of the accommodating portion 400 on which the object M is seated is formed of wires unlike the conventional plate-type shelves of the supercooling refrigerator, the contact area between the cool air and the object M may be increased, resulting in increased cooling efficiency. Further, the bottom of the shelf 410 is also formed of wires rather than as a flat plate, so that the bottom surface of the object M may also be effectively cooled, thereby further increasing the cooling efficiency.

In addition, the cold insulator 430 is inserted into the wires forming the shelf 410, so that, even when the cooling cycle does not operate, the change in the internal temperature of the refrigerator body 100 may be made gentle with the cool air stored in the cold insulator 430 of the low temperature. With this configuration, the operating frequency of the cooling cycle, that is, the operating frequency of the compressor may be lowered, thereby increasing the service life of the compressor, which is also effective in reducing power consumption and noise.

In addition, the shelf 410 is provided with guide wires that divide the objects M in the width direction so that the objects M can be prevented from collapsing, or freezing due to an external impact or internal vibrations.

In addition, the cold insulation member 632 is also attached to the refrigerant flow pipe 631 of the evaporator 630. Therefore, as in the case of the cold insulator 430 of the shelf 410, even when the cooling cycle does not operate, the change in the internal temperature of the refrigerator body 100 may be made gentle with the cool air stored in the cold insulation member 632 of the low temperature. With this configuration, the operating frequency of the cooling cycle, that is, the operating frequency of the compressor may be lowered, so that the life of the compressor may be further increased, and the power consumption and the noise may be further effectively reduced.

Further, the door 200 is formed of double glasses 210 with a spacer 220 interposed therebetween, and the argon gas, the krypton gas or the nitrogen gas is enclosed in the spacer 220 to reduce the heat transfer according to the temperature difference between the inside and the outside of the supercooling refrigerator 1000, thereby preventing the condensation phenomenon. With this configuration, unlike the conventional supercooling refrigerator, it is not necessary to provide a separate defrost heater in the door 200, so that the configuration may be simplified and power consumption may be reduced.

Further, unlike a conventional supercooling refrigerator in which a separate heater is installed in the evaporator 630 for defrosting, the supercooling refrigerator 1000 according to the present invention employs the hot-gas defrosting method that reversely drives the cooling cycle to perform defrosting using a relatively high-temperature refrigerant, so that power consumption may be reduced. In addition, the water generated after the defrosting is collected in the water collector 310 of the machine chamber 300 and then naturally evaporated by the heat and wind generated during driving the cooling cycle, thereby simplifying the structure and reducing inconvenience in use as compared with the conventional supercooling refrigerator.

That is, the supercooling refrigerator 1000 according to the present invention may reduce the frequency of operating the cooling cycle (compressor) to thus increase the service life of the compressor, and may employ a small compressor (for example, a ⅕ horsepower or a ⅓ horsepower compressor) instead of a conventional large capacity compressor to thus reduce power consumption and noise. Further, the supercooling refrigerator 1000 according to the present invention may reduce the amount of cool air escaping when the door is opened, uniformly supply the low-speed cool air to the interior of the refrigerator, and does not employ a heater to thus further reduce power consumption.

Note that, in the supercooling refrigerator 1000 according to the embodiment of the present invention, it is described that there is one door 200, but the present invention is not limited thereto. For example, a plurality of the doors 200 may be formed to correspond to each position of the plurality of shelves 410. With this configuration, user can selectively open and close only the door 200 corresponding to the shelf 410 on which the desired object M is seated, and in this case, the amount of cool air escaping outside may be further reduced. Further, a cool air escape preventing curtain formed of acrylic, vinyl resin material or the like may be formed between the refrigerator body 100 and the door 200, so that the amount of cool air escaping outside may be further reduced.

In addition, in the supercooling refrigerator 1000 according to the embodiment of the present invention, it is described that the vibrations or shocks applied to the object M in the shelf 410 are suppressed by the guide wires, but the present invention is not limited thereto. For example, in addition to the guide wires, by adding an anti-vibration member formed of rubber or the like to a coupling portion of the shelf 410 and the shelf support 420, the vibrations or shocks applied to the object M seated on the shelf 410 may further be suppressed.

Further, in the supercooling refrigerator 1000 according to the embodiment of the present invention, it is described that the objects M seated on the shelf 410 are adjacent to each other in the width direction, but the present invention is not limited thereto. For example, the guide wires may be wider or a plurality of guide wires may be provided between the objects M in the width direction so that the objects M are spaced apart from each other in the width direction. With this configuration, the contact area between the object M and cool air may be widened, resulting in further enhanced cooling efficiency.

The present invention has been described in detail. However, it should be understood that the detailed description and specific examples, while indicating preferred embodiments of the present invention, are given byway of illustration only, since various changes and modifications within the scope of the present invention will become apparent to those skilled in the art from this detailed description. Accordingly, the embodiments disclosed in the present invention are provided to explain, not to limit a technical art of the present invention, and thus, the scope of the present invention is not limited. A scope of a protection of the present invention should be construed by following claims, and every technical art within a same scope of the following claims should be construed to be included in a scope of a right of the present invention.

DESCRIPTION OF REFERENCE NUMERALS

100: refrigerator body
110: heat insulator
200: door
210: glass
220: spacer
230: anti-frost film
300: machine chamber
310: water collector
400: accommodating portion
410: shelf
411: first wire
412: second wire
420: shelf support
430: cold insulator
500: controller
510: power supply
520: input unit
530: display unit
540: calculation unit
550: adjusting unit
600: cooling duct
610: intake port
620: cross flow fan
621: housing
622: disc
623: blade
624: guide plate
625: fan motor
630: evaporator
631: refrigerant flow pipe
632: cold insulation member
640: introducing port
700: cool air supply duct
710: cool air discharge port
720: cool air discharge mesh
730: cool air flow rate adjusting unit
800: sensor
1000: supercooling refrigerator

The invention claimed is:

1. A supercooling refrigerator (1000), comprising:

a refrigerator body (100);

a door (200) for opening and closing one side of the refrigerator body (100);

an accommodating member (400) provided inside the refrigerator body (100) and seated with an object (M) to be stored;

a cooling duct (600) including a fan for taking in air in the refrigerator body (100) and discharging the air, and an evaporator (630) for cooling the air discharged from the fan; and a cool air supply duct (700) formed with a cool air discharge port (710) through which the air cooled through the cooling duct (600) is discharged into the refrigerator body (100), wherein the fan is a cross flow fan (620) including a plurality of discs (622) and a plurality of blades (623) disposed between the discs (622) along outer circumferential surfaces of the discs (622), and wherein the accommodating member (400) includes a plurality of shelves (410) formed by wires crossed with each other and shelf supports (420) for supporting the shelves (410), and a cold insulator (430) is inserted into the wires such that the wires are at least partially filled with the cold insulator.

2. The supercooling refrigerator (1000) of claim 1, wherein a cool air flow rate adjusting members (730) is formed on an upstream side of the cool air supply duct (700) through which the cooled air flows, such that a cross sectional area of a flow of the cooled air is narrowed.

3. The supercooling refrigerator (1000) of claim 1, wherein the evaporator (630) includes a refrigerant flow pipe (631) through which a refrigerant is moved and a cold insulation member (632) fitted onto the refrigerant flow pipe (631) and supported thereon.

4. The supercooling refrigerator (1000) of claim 1, wherein the cool air supply duct (700) includes a cool air discharge mesh (720) attached to the cool air discharge port (710) in a direction of the door (200).

5. The supercooling refrigerator (1000) of claim 1, wherein the door (200) includes a plurality of glasses (210) stacked on each other with a spacer (220) interposed therebetween, and a heat insulating gas is sealed in the spacer (220).

6. The supercooling refrigerator (1000) of claim 1, further comprising:

a machine chamber (300) installed in a side of there refrigerator body (100) to drive a cooling cycle of the supercooling refrigerator (1000), wherein, during defrosting, the machine chamber (300) defrosts the evaporator (630) using a hot gas defrosting method, and defrosted water is collected into a water collector (310) provided in the machine chamber (300) and evaporated.

* * * * *